US010907837B2

(12) United States Patent
Roberts et al.

(10) Patent No.: US 10,907,837 B2
(45) Date of Patent: Feb. 2, 2021

(54) MOUNTING ARRANGEMENT FOR A USER INTERFACE OF A GAS COOKING APPLIANCE

(71) Applicant: Whirlpool Corporation, Benton Harbor, MI (US)

(72) Inventors: Anthony S. Roberts, Granger, IN (US); Fernando Dos Santos, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 735 days.

(21) Appl. No.: 15/208,243

(22) Filed: Jul. 12, 2016

(65) Prior Publication Data

US 2018/0017263 A1 Jan. 18, 2018

(51) Int. Cl.
*F24C 3/12* (2006.01)
*F24C 3/08* (2006.01)

(52) U.S. Cl.
CPC ..... *F24C 3/124* (2013.01); *F24C 3/082* (2013.01); *F24C 3/122* (2013.01); *F24C 3/126* (2013.01)

(58) Field of Classification Search
CPC combination set(s) only.
See application file for complete search history.

(56) References Cited

U.S. PATENT DOCUMENTS 1,969,163 A 8/1934 Stevenson
4,417,483 A 11/1983 Howie, Jr.
6,627,828 B1 9/2003 McCartney
7,322,616 B2 1/2008 Lang
7,490,628 B2 2/2009 Frost et al.
7,543,856 B2 6/2009 Lang
8,079,287 B2 12/2011 Castillo
8,662,102 B2 3/2014 Shaffer et al.
8,674,246 B2 3/2014 Steffens
8,733,204 B2 5/2014 Voss et al.
9,038,621 B2 5/2015 Cadima
9,103,553 B2 8/2015 Daughtridge, Jr. et al.
2015/0323191 A1 11/2015 Yang et al.
2017/0089586 A1* 3/2017 Turner ..... F24C 3/122

FOREIGN PATENT DOCUMENTS

DE 202009009727 11/2009

* cited by examiner

*Primary Examiner* — Steven B McAllister
*Assistant Examiner* — Elizabeth M. May
(74) *Attorney, Agent, or Firm* — Diederiks & Whitelaw, PLC.

(57) ABSTRACT

A gas cooking appliance includes a valve and a first pipe configured to transport gas to the valve. The appliance also includes a burner and a second pipe configured to transport gas from the valve to the burner. The appliance further includes a console and a knob. The console includes a cutout having an edge defining a shape of the cutout, and the knob includes a handle and a bezel. The knob is configured to control a state of the valve. The bezel has a rear face and a protrusion extending rearward from the rear face through the cutout, the protrusion contacting the edge of the cutout. The appliance additionally includes a bracket coupling the knob to the valve. The bracket includes a leg mating with the protrusion.

23 Claims, 5 Drawing Sheets

MOUNTING ARRANGEMENT FOR A USER INTERFACE OF A GAS COOKING APPLIANCE

BACKGROUND OF THE INVENTION

The present invention pertains to cooking appliances and, more particularly, to user interfaces for cooking appliances.

Typically, a cooking appliance includes a user interface that allows a user to interact with the appliance. For example, the user might be able to adjust the temperature of a burner using a knob or select an oven temperature using one or more buttons. One issue that arises in connection with the use of knobs is the potential misalignment of a knob during manufacture of a gas cooking appliance. This misalignment can be relative to a bezel of the knob, a console of the appliance or another knob. To address this issue, one option is to use tight tolerances for certain appliance structure during manufacture. Another option is to manually reposition the valve stems to which the knobs are coupled. As a further option, flexible tubing can be used in connection with the valves of the appliance. Also, expensive machined guides and alignments aids have been employed. However, these options have various downsides, such as requiring additional assembly steps, increasing costs or increasing the risk of damage to the valve stems. In addition, there are limits to the results that are achievable using some of these options. Accordingly, there is a need in the art for a simple, effective and economical system and method for aligning the knobs of a gas cooking appliance during manufacture.

SUMMARY OF THE INVENTION

The present invention is directed to a system and method for aligning the knobs of a gas cooking appliance. In particular, a gas cooking appliance includes a valve and a first pipe configured to transport gas to the valve. The appliance also includes a burner and a second pipe configured to transport gas from the valve to the burner. The appliance further includes a console and a knob. The console includes a cutout having an edge defining a shape of the cutout, and the knob includes a handle and a bezel. The knob is configured to control a state of the valve. The bezel has a rear face and a protrusion extending rearward from the rear face through the cutout, the protrusion contacting the edge of the cutout. The appliance additionally includes a bracket coupling the knob to the valve. The bracket includes a leg mating with the protrusion.

The console defines an interior space inaccessible to a user of the gas cooking appliance. The console also defines an exterior space accessible to the user. The rear face of the bezel is located in the exterior space, and the protrusion extends from the exterior space to the interior space. In one embodiment, the protrusion includes a hole, and the leg fits inside the hole. In another embodiment, the leg includes an opening, and the protrusion fits inside the opening. The protrusion and leg have complementary shapes. Also, a fastener extends through a first hole in the protrusion and is threaded into a second hole in the leg. The protrusion has a side that contacts the edge of the cutout. In one embodiment, the edge of the cutout defines some of but less than all of a circle.

In a further embodiment, the protrusion is one of a plurality of protrusions extending rearward from the rear face of the bezel through the cutout. The plurality of protrusions contacts the edge of the cutout. Also, the bracket is a spider bracket. The bracket further includes a body directly coupled to the valve. In addition, the leg is one of a plurality of legs of the bracket. Each of the plurality of legs is configured to mate with a respective one of the plurality of protrusions. In yet another embodiment, the valve includes a valve stem, and the rotational position of the valve stem determines the state of the valve. The handle is directly coupled to the valve stem, and the knob is configured to control the state of the valve via rotation of the valve stem with the handle.

Mounting the user interface of the gas cooking appliance includes forming the cutout in the console and coupling the knob to the valve using the bracket. In one embodiment, coupling the knob to the valve includes inserting the leg into the hole of the protrusion. In another embodiment, coupling the knob to the valve includes inserting the protrusion into the opening of the leg.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

Figure 1A:
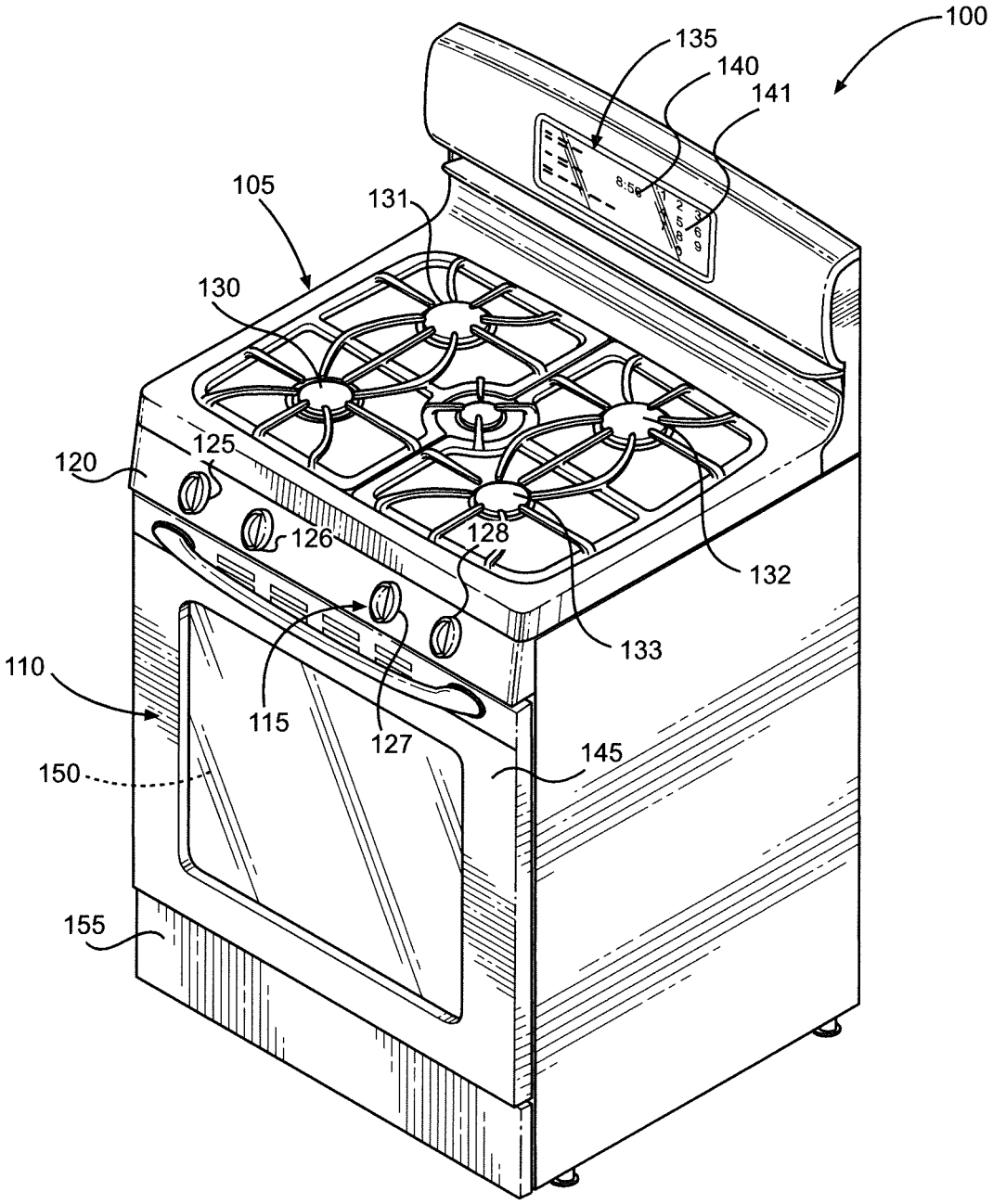
FIG. 1A is a perspective view of a cooking appliance constructed in accordance with the present invention.

With initial reference to FIG. 1, there is shown a cooking appliance 100 in accordance with the present invention. Appliance 100 is illustrated as a gas range generally including a cooktop 105 and an oven 110. However, the present invention can be used with other gas cooking appliances, such as a stand-alone gas cooktop. Appliance 100 includes a first user interface 115 integrated into a console 120. First user interface 115 enables a user of appliance 100 to control cooktop 105. In particular, user interface 115 includes a plurality of knobs 125-128 for controlling a plurality of burners 130-133. A second user interface 135 includes a display 140 and a plurality of buttons 141 for controlling oven 110. Alternatively, a touchscreen display can be used to control oven 110. Appliance 100 further includes a door 145 that allows selective access to an oven cavity 150 and a drawer 155 that provides additional storage.

Figure 1B:
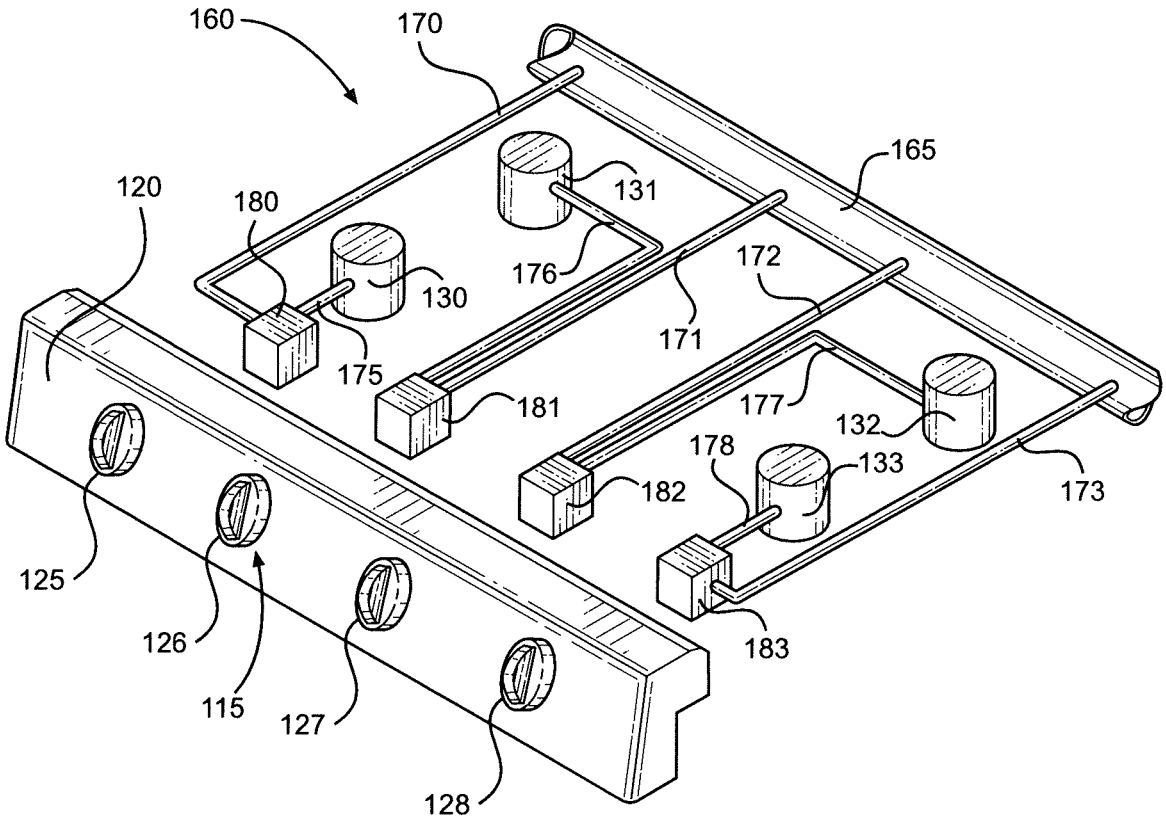
FIG. 1B is a schematic view of a portion of a gas delivery system of the cooking appliance.

With reference now to FIG. 1B, a portion of a gas delivery system 160 of appliance 100 is illustrated. System 160 routs gas to the various cooking elements of appliance 100, i.e., burners 130-133, oven 110, etc., where the gas is ignited and burned to provide the heat used to cook food with appliance 100. System 160 includes a primary pipe or manifold 165, a first plurality of secondary pipes 170-173 and a second plurality of secondary pipes 175-178. Primary pipe 165 receives gas from a domestic gas line (not shown) and transports the gas to pipes 170-173. Pipes 170-173 transport gas from primary pipe 165 to a plurality of valves 180-183 that are controlled by knobs 125-128. Specifically, each of knobs 125-128 controls the open or closed state of a corresponding one of valves 180-183, as well as the amount of gas passing through valves 180-183 when valves 180-183 are open, i.e., controls the degree of opening of a respective valve 180-183. Gas passing through valves 180-183 is transported to burners 130-133 by pipes 175-178. Gas arriving at burners 130-133 is ignited and burned, thereby enabling a user to cook food using appliance 100. As certain additional structure of such cooking appliances can take various forms, is generally known in the art and is not part of the present invention, it will not be detailed further herein. Similarly, the operation of such cooking appliances is generally known in the art and not part of the present invention and will therefore not be detailed further herein.

Figure 2A:
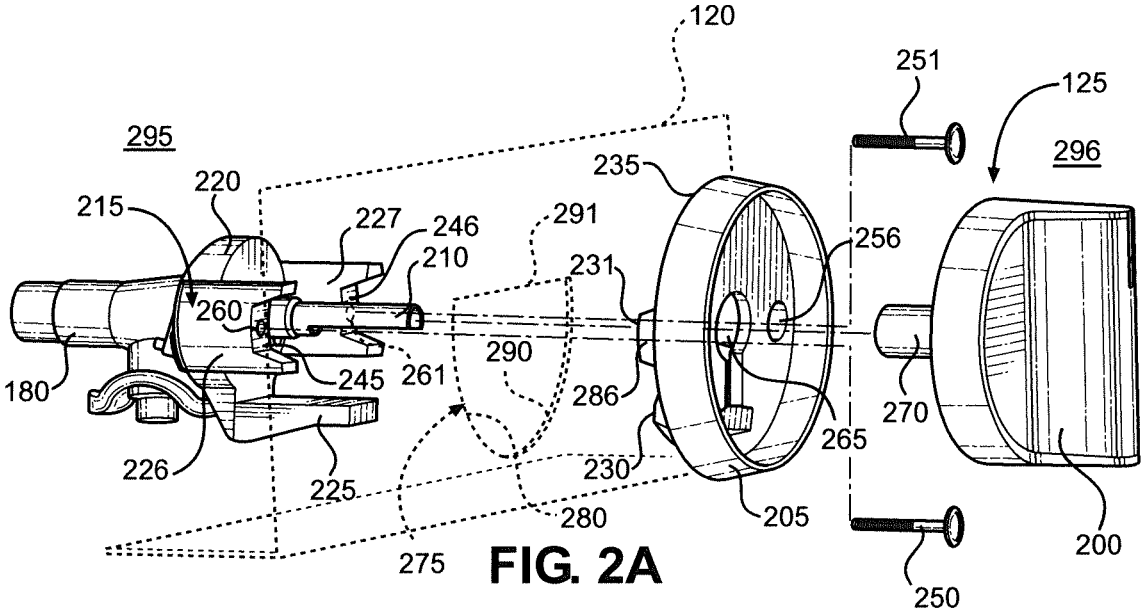
FIG. 2A is a front perspective view of a mounting arrangement for a knob of the cooking appliance in accordance with a first embodiment.
Figure 2B:
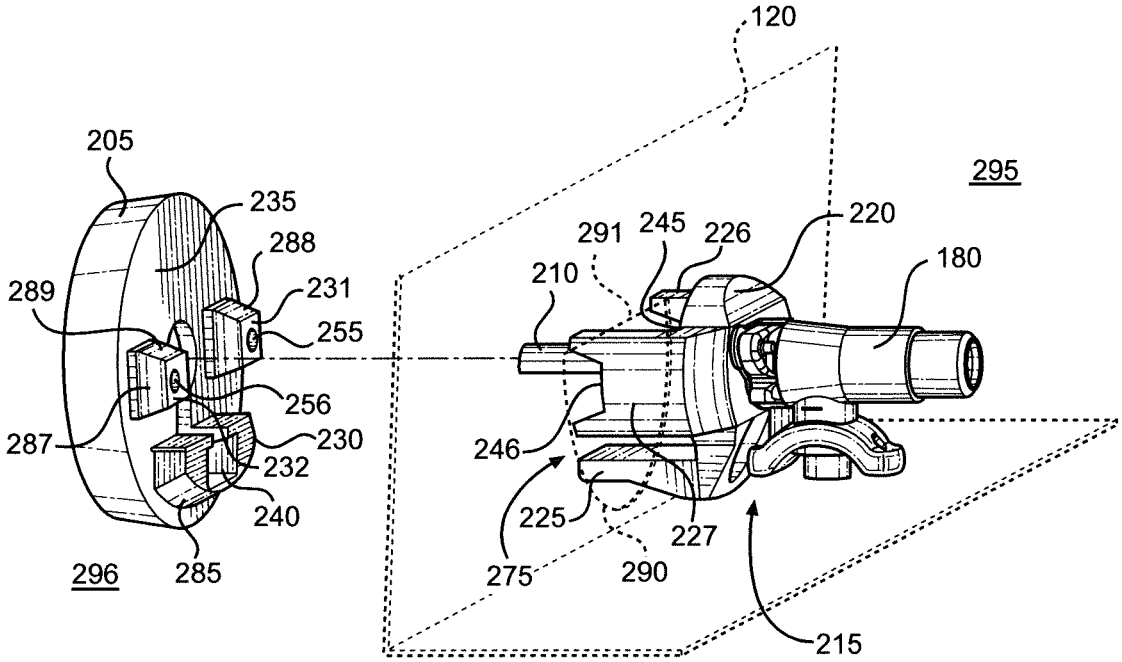
FIG. 2B is a rear perspective view of the mounting arrangement of the first embodiment.
Figure 2C:
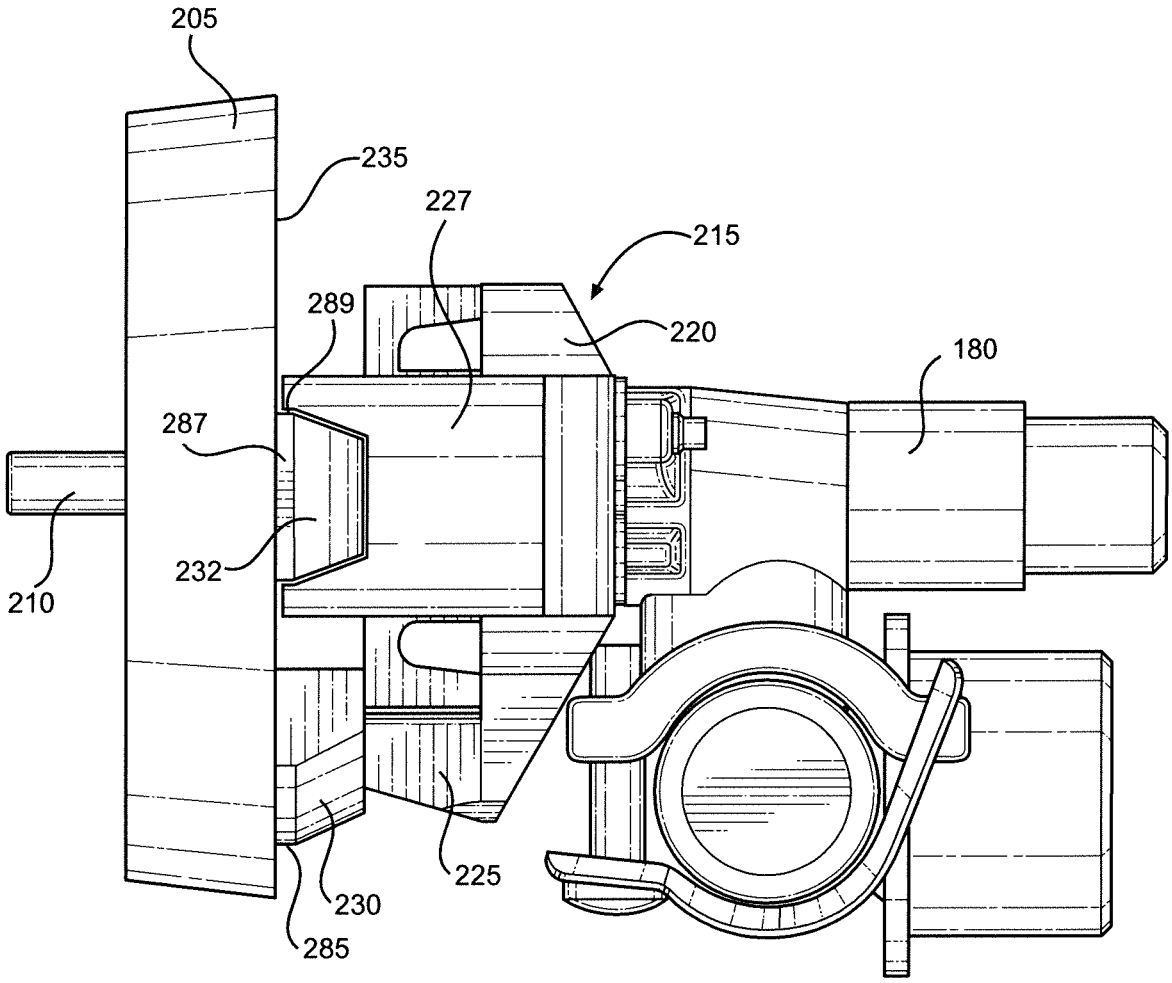
FIG. 2C is a side view of the mounting arrangement of the first embodiment.

Turning to FIGS. 2A-C, a mounting arrangement for knob 125 is shown. Although the following discussion is directed to knob 125, the discussion applies equally to knobs 126-128. Knob 125 includes a handle 200 and a bezel 205. Handle 200 is directly and rotatably coupled to valve 180 such that handle 200 can be rotated by a user relative to bezel 205, which is fixed in place. Specifically, handle 200 is directly coupled to a valve stem 210 of valve 180 such that valve stem 210 can be rotated relative to valve 180 by handle 200, with valve 180 being fixed in place. Rotation of valve stem 210 controls the state of valve 180, i.e., a rotational position of valve stem 210 determines the state of valve 180. As referenced above, valve 180 can be in a closed state, where no gas passes through valve 180, or an open state, where a non-zero amount of gas passes through valve 180. The open state includes both a fully open state, as well as a range of partially open states. In other words, in the fully open state, a maximum possible amount of gas passes through valve 180 and, in each of the partially open states, some non-zero percentage of this maximum amount of gas passes through valve 180.

More specifically, knob 125 is coupled to valve 180 using a bracket 215. Preferably, bracket 215 is a spider bracket, as illustrated in FIGS. 2A-C. For purposes of the present invention, a spider bracket is defined as a bracket having a body and a plurality of legs extending from the body, the body being coupled to one object and the plurality of legs being coupled to one or more other objects. In this case, bracket 215 has a body 220 and a plurality of legs 225-227. Body 220 is directly coupled to valve 180, and legs 225-227 are configured to mate with a plurality of protrusions 230-232 located on a rear face 235 of bezel 205. In particular, leg 225 fits in a hole 240 formed in protrusion 230, while legs 226 and 227 include openings or notches 245 and 246 in which protrusions 231 and 232 fit. As can be seen in FIGS. 2A-C, legs 225-227 and protrusions 230-232 are shaped to complement one another, e.g., protrusion 231 and notch 245 have complementary shapes. By complementary, it is meant that the the positive space defined by one object matches the negative space defined by the other object. Once legs 225-227 and protrusions 230-232 are mated, fasteners 250 and 251 are inserted through holes 255 and 256 formed in bezel 205 and threaded into holes 260 and 261 formed in legs 226 and 227 in order to secure bezel 205 to bracket 215 and thereby secure bezel 205 to valve 180. With bezel 205 secured to valve 180, valve stem 210 extends through a hole 265 formed in the center of bezel 205, and handle 200 is mated with valve stem 210. Specifically, valve stem 210 fits into and is keyed to a hollow shaft 270 extending rearward from handle 200.

The desired alignment of knob 125 is particularly provided by the interaction between protrusions 230-232 and a cutout 275. Cutout 275 is essentially a hole in console 120 through which portions of knob 125 and valve 180 extend. In the embodiment shown, cutout 275 is in the shape of a partial circle, i.e., an edge 280 of cutout 275 defines some of, but less than all of, a circle. In a preferred form, cutout 275 has an area greater than that of a semicircle but less than than of a full circle. However, as should become clear, cutout 275 can take a variety of shapes. In any case, protrusions 230-232 are located and shaped such that protrusions 230-232 contact edge 280 of cutout 275. Since protrusions 230-232 extend rearward from rear face 235, it is the sides of protrusions 230-232 that contact edge 280. Specifically, in the embodiment shown, sides 285-287 of protrusions 230-232 contact an arcuate portion 290 of cutout 275, while sides 288 and 289 of protrusions 231 and 232 contact a straight portion 291 of cutout 275. To match the corresponding portions of edge 280, sides 285-287 are arcuate, and sides 288 and 289 are straight. The result of this arrangement is that contact between protrusions 230-232 and edge 280 forces bezel 205 into a specific, predetermined position when bezel 205 is coupled to bracket 215, thereby ensuring that knob 125 will be properly and accurately aligned.

As can be best seen in FIG. 2B, console 120 defines an interior space 295 and an exterior space 296. Interior space 295 is inaccessible to a user of appliance 100, while exterior space 296 is accessible to the user. Handle 200 and bezel 205 are located in exterior space 296, and bracket 215 and valve 180 (except for part of valve stem 210) are located in interior space 295. Also, rear face 235 of bezel 205 is located in exterior space 296, while protrusions 230-232 extend from exterior space 296 to interior space 295. For purposes of the present invention, an object is considered to be located in a given space if a majority of the object is located in the space.

Figure 3A:
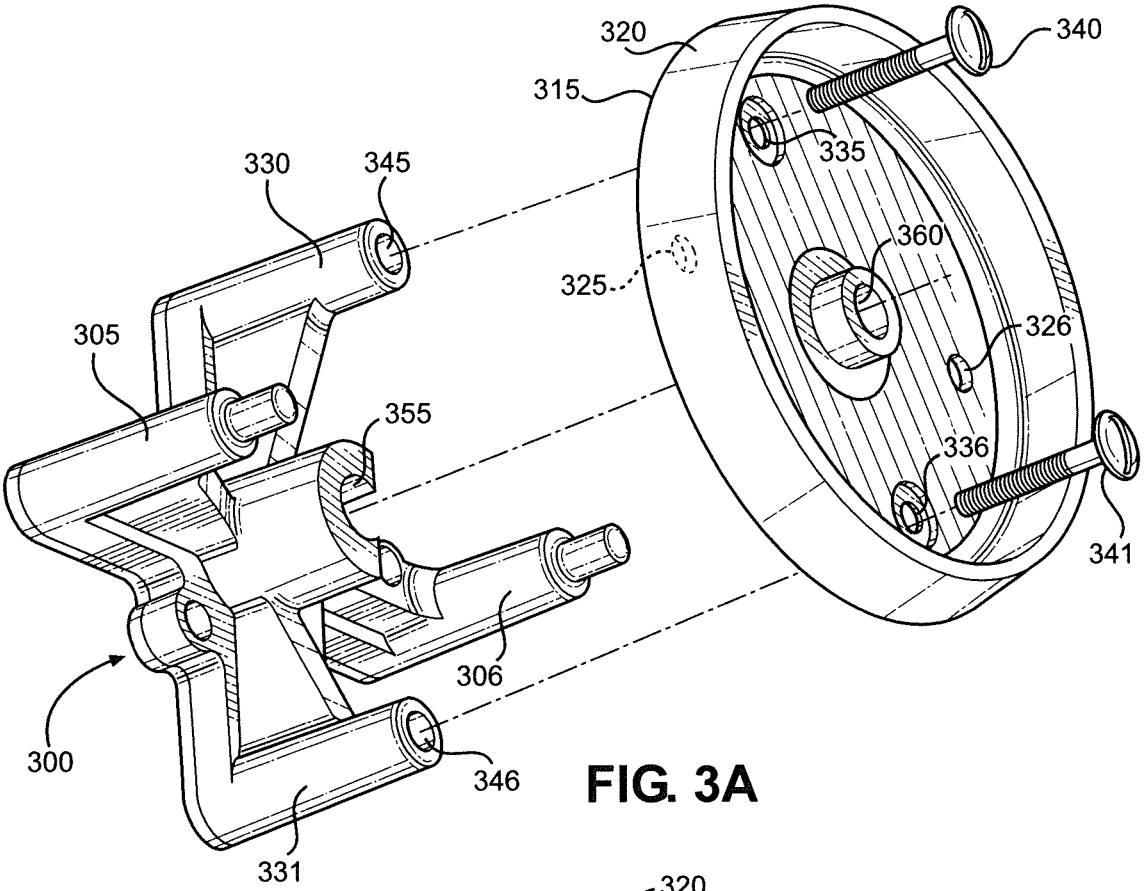
FIG. 3A is a front perspective view of a mounting arrangement for a knob of the cooking appliance in accordance with a second embodiment.
Figure 3B:
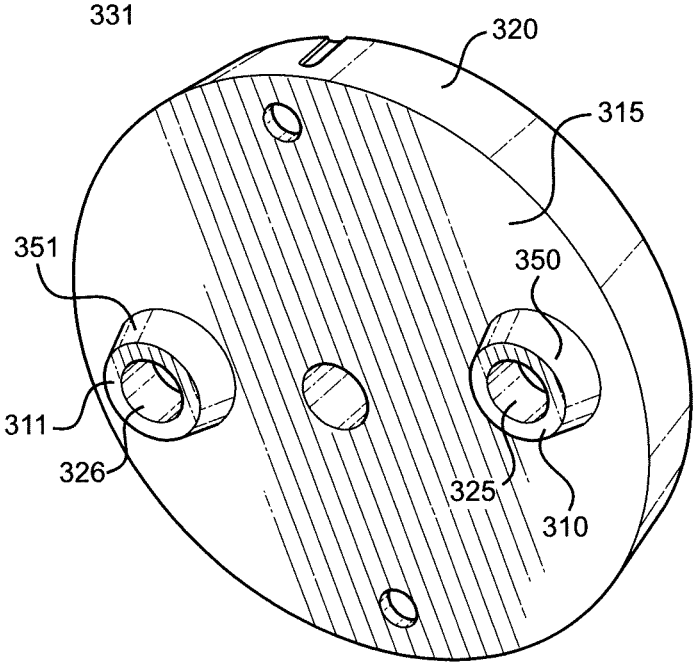
FIG. 3B is a rear perspective view of the mounting arrangement of the second embodiment.

An alternative mounting arrangement for use with the present invention is shown in FIGS. 3A and 3B. In this embodiment, bracket 215 is replaced with a bracket 300, which is also a spider bracket. Bracket 300 includes legs 305 and 306, which are configured to mate with protrusions 310 and 311 extending rearward from a rear face 315 of a bezel 320. In particular, legs 305 and 306 fit inside holes 325 and 326 formed in protrusions 310 and 311. Bracket 300 also includes legs 330 and 331, which align with holes 335 and 336 formed in bezel 320 when bracket 300 is coupled to bezel 320. Fasteners 340 and 341 are inserted through holes 335 and 336 and threaded into holes 345 and 346 formed in legs 330 and 331 to secure bracket 300 to bezel 320. As with the embodiment of FIGS. 2A-C, protrusions 310 and 311 contact an edge of a cutout (not shown) formed in console 120 to align bezel 320 and therefore also align the knob of which bezel 320 is a part. Specifically, protrusions 310 and 311 have arcuate, tapering sides 350 and 351 that are in contact with the edge of the cutout. At this point, it should be recognized that the cutout can take various other forms.

For instance, the cutout could be circular, or even shaped like cutout 275 with additional holes provided in console 120 for fasteners 340 and 341. In any case, as with bracket 215, bracket 300 is directly coupled to valve 180, with valve stem 210 extending through holes 355 and 360 formed in bracket 300 and bezel 320, respectively. In general, bracket 300 functions in the same manner as bracket 215 except for those differences highlighted above.

Although two particular leg/protrusion/cutout arrangements have been described, it should be understood that a wide variety of arrangements can be used in connection with the present invention. For example, as has been demonstrated, different numbers of legs and protrusions can be used. Also, the shapes of the legs, protrusions and cutout can vary. With respect to the cutout, it should also be noted that, instead of a circle or partial circle, the cutout can be an oval or polygon, for instance. In addition, the cutout can comprise a plurality of holes through which the protrusions, valve stem and fasteners pass rather than a single hole. Similarly, instead of a plurality of protrusions having corresponding holes, a single protrusion can be used having one or more holes.

Based on the above, it should be readily apparent that the present invention provides a simple, effective and economical system and method for aligning the knobs of a gas cooking appliance during manufacture. Although described with reference to preferred embodiments, it should be readily understood that various changes or modifications could be made to the invention without departing from the spirit thereof. Furthermore, even though certain objects have been described as defining a portion of a circle, for purposes of the present invention, this does not require that such objects define a portion of a perfect circle. For instance, the term "circular" is intended to encompass ellipses, or portions thereof. In general, the invention is only intended to be limited by the scope of the following claims.

The invention claimed is:

1. A gas cooking appliance comprising:
- a valve;
- a first pipe configured to transport gas to the valve;
- a burner;
- a second pipe configured to transport gas from the valve to the burner;
- a console including a cutout, the cutout having an edge defining a shape of the cutout;
- a knob including a handle and a bezel, the knob being configured to control a state of the valve, wherein the bezel has a rear face and a protrusion extending rearward from the rear face through the cutout, the protrusion contacts the edge of the cutout, and the protrusion is one of a plurality of protrusions extending rearward from the rear face of the bezel through the cutout; and
- a bracket coupling the knob to the valve, wherein the bracket includes a leg mating with the protrusion, the leg is one of a plurality of legs of the bracket, and each of the plurality of legs is configured to mate with a respective one of the plurality of protrusions.

2. The gas cooking appliance of claim 1, wherein:
- the console defines an interior space inaccessible to a user of the gas cooking appliance;
- the console defines an exterior space accessible to the user;
- the rear face of the bezel is located in the exterior space; and
- the protrusion extends from the exterior space to the interior space.

3. The gas cooking appliance of claim 1, wherein:
- the protrusion includes a hole, and the leg fits inside the hole; or
- the leg includes an opening, and the protrusion fits inside the opening.

4. The gas cooking appliance of claim 3, wherein the protrusion and leg have complementary shapes.

5. The gas cooking appliance of claim 1, further comprising a fastener extending through a first hole in the protrusion and threaded into a second hole in the leg.

6. The gas cooking appliance of claim 1, wherein the protrusion has a side that contacts the edge of the cutout.

7. The gas cooking appliance of claim 6, wherein the edge of the cutout defines some of but less than all of a circle.

8. The gas cooking appliance of claim 1, wherein:
- the plurality of protrusions contacts the edge of the cutout;
- the bracket is a spider bracket; and
- the bracket further includes a body directly coupled to the valve.

9. The gas cooking appliance of claim 1, wherein:
- the valve includes a valve stem;
- a rotational position of the valve stem determines the state of the valve;
- the handle is directly coupled to the valve stem; and
- the knob is configured to control the state of the valve via rotation of the valve stem with the handle.

10. A mounting arrangement for a user interface of a gas cooking appliance, the mounting arrangement comprising:
- a valve including a valve stem, wherein the valve stem has a longitudinal axis;
- a console including a cutout, the cutout having an edge defining a shape of the cutout;
- a knob including a handle and a bezel, the knob being configured to control a state of the valve, wherein the bezel has a rear face and a protrusion extending rearward from the rear face through the cutout, and wherein the protrusion contacts the edge of the cutout; and
- a bracket coupling the knob to the valve, wherein the bracket includes a leg mating with the protrusion, the leg has a longitudinal axis, and the longitudinal axis of the leg is radially offset from the longitudinal axis of the valve stem.

11. The mounting arrangement of claim 10, wherein:
- the console defines an interior space inaccessible to a user of the gas cooking appliance;
- the console defines an exterior space accessible to the user;
- the rear face of the bezel is located in the exterior space; and
- the protrusion extends from the exterior space to the interior space.

12. The mounting arrangement of claim 10, wherein:
- the protrusion includes a hole, and the leg fits inside the hole; or
- the leg includes an opening, and the protrusion fits inside the opening.

13. The mounting arrangement of claim 12, wherein the protrusion and leg have complementary shapes.

14. The mounting arrangement of claim 10, further comprising a fastener extending through a first hole in the protrusion and threaded into a second hole in the leg.

15. The mounting arrangement of claim 10, wherein the protrusion has a side that contacts the edge of the cutout.

16. The mounting arrangement of claim 15, wherein the edge of the cutout defines some of but less than all of a circle.

17. The mounting arrangement of claim 10, wherein:

the protrusion is one of a plurality of protrusions extending rearward from the rear face of the bezel through the cutout;

the plurality of protrusions contacts the edge of the cutout;

the bracket is a spider bracket;

the bracket further includes a body directly coupled to the valve;

the leg is one of a plurality of legs of the bracket; and each of the plurality of legs is configured to mate with a respective one of the plurality of protrusions.

18. The mounting arrangement of claim 10, wherein:

a rotational position of the valve stem determines the state of the valve;

the handle is directly coupled to the valve stem; and the knob is configured to control the state of the valve via rotation of the valve stem with the handle.

19. A method of mounting a user interface of a gas cooking appliance comprising a valve including a valve stem, a first pipe configured to transport gas to the valve, a burner and a second pipe configured to transport gas from the valve to the burner, the method comprising:

forming a cutout in a console, the cutout having an edge defining a shape of the cutout;

coupling a knob to the valve using a bracket, the knob being configured to control a state of the valve, wherein the knob includes a handle and a bezel, the bezel has a rear face and a protrusion extending rearward from the rear face through the cutout, the protrusion contacts the edge of the cutout, the bracket includes a leg, the leg mates with the protrusion, the valve stem has a longitudinal axis, the leg has a longitudinal axis, and the longitudinal axis of the leg is radially offset from the longitudinal axis of the valve stem.

20. The method of claim 19, wherein coupling the knob to the valve using the bracket includes:

inserting the leg into a hole of the protrusion; or inserting the protrusion into an opening of the leg.

21. The gas cooking appliance of claim 1, wherein the cutout and the plurality of protrusions are configured such that contact between the plurality of protrusions and the edge of the cutout prevents relative rotation between the bezel and the console.

22. The gas cooking appliance of claim 1, wherein the plurality of protrusions and the plurality of legs are configured such that contact between the plurality of protrusions and the plurality of legs prevents relative rotation between the bezel and the bracket.

23. The mounting arrangement of claim 10, wherein the cutout and the protrusion are configured such that contact between the protrusion and the edge of the cutout prevents relative rotation between the bezel and the console, and the protrusion and the leg are configured such that contact between the protrusion and the leg prevents relative rotation between the bezel and the bracket.

* * * * *